US007357004B2

(12) United States Patent
Winston et al.

(10) Patent No.: US 7,357,004 B2
(45) Date of Patent: Apr. 15, 2008

(54) FLEXIBLE LINKAGE FOR JEWELRY AND METHOD OF MAKING

(75) Inventors: Ronald Winston, Scarsdale, NY (US); Matthew Spitaleri, Long Beach, NY (US)

(73) Assignee: Harry Winston, Inc., New York, NY (US)

( * ) Notice: Subject to any disclaimer, the term of this patent is extended or adjusted under 35 U.S.C. 154(b) by 89 days.

(21) Appl. No.: 11/003,068

(22) Filed: Dec. 3, 2004

(65) Prior Publication Data

US 2005/0120746 A1 Jun. 9, 2005

Related U.S. Application Data

(60) Provisional application No. 60/626,774, filed on Nov. 10, 2004, provisional application No. 60/526,828, filed on Dec. 4, 2003.

(51) Int. Cl.
*A44C 9/02* (2006.01)

(52) U.S. Cl. ..... 63/15.45; 63/15.7

(58) Field of Classification Search ..... None
See application file for complete search history.

(56) References Cited

U.S. PATENT DOCUMENTS

| | | | | |
|---|---|---|---|---|
| RE668 E | | 2/1859 | Friand et al. | |
| 281,371 A | * | 7/1883 | Keller | 59/79.3 |
| 919,486 A | * | 4/1909 | Speidel | 59/79.1 |
| 1,018,663 A | | 2/1912 | Harrop | |
| 1,079,489 A | | 11/1913 | Higham | |
| 2,429,393 A | * | 10/1947 | Cedar | 59/79.3 |
| 2,902,749 A | | 9/1959 | Manne | |
| 6,094,939 A | * | 8/2000 | Gavello | 63/3 |

FOREIGN PATENT DOCUMENTS

| | | |
|---|---|---|
| DE | 297 15 033 | 6/1968 |
| GB | 212043 | 3/1924 |
| GB | 232372 | 4/1925 |

* cited by examiner

*Primary Examiner*—Jack W. Lavinder
(74) *Attorney, Agent, or Firm*—Carella, Byrne, Bain et al.; William Squire

(57) ABSTRACT

A jewelry article optionally with one or more gemstones, includes one or more hollow core segments with at least one bore in a side wall, and optionally an element interconnected with the one or more of the segments formed by a flexible linkage. A segment may include a setting with rods to receive a gemstone. The segment(s), and optionally the element, are preferably in an annular array to form a ring, necklace and the like and may be of the same or different configurations. The segments also may have different arcuate circumferential lengths and cross sectional shapes preferably frusto-conical and may comprise only a portion of an article such as a finger ring or necklace and the like periphery. The linkage is formed by a pin secured to one segment or element and which pin passes through the bore into the hollow core of the adjacent abutting segment. A coil compression spring is captured to the pin in the hollow core of a segment and urges the adjacent components together. The spring and pin permit the normally abutting components to resiliently move relative to each other to permit relative expansion along the pin length. Pins in an array of segments are offset with the central plane of a ring type article to permit a gemstone to be seated deep within the core.

30 Claims, 14 Drawing Sheets

FLEXIBLE LINKAGE FOR JEWELRY AND METHOD OF MAKING

This application claims the benefit of provisional applications Ser. No. 60/526,828 filed Dec. 4, 2003 entitled "Flexible Linkage for Jewelry and Method of Making" and Ser. No. 60/626,774 filed Nov. 10, 2004 entitled "Flexible Linkage for Jewelry and Method of Making" incorporated by reference herein in their entireties.

This invention relates to jewelry, and more particularly to body or clothing adornment jewelry having multiple elements which together can expand to accommodate various annular body parts or for decoration, for example, finger rings, necklaces, brooches, decorative pins, bracelets or anklets and so on.

The problem generally with finger rings, chokers, bracelets, anklets and so on is that in practice such articles are formed into relatively one circumferential fixed dimension and thus fit only one size annular body part such as a finger, the neck, a wrist or ankle, for example. However, such body parts tend to change in size over time due to various factors or differ from person to person by significant amounts. A person may particularly like a jewelry item, but may not be able to use it because it is too small for the person's neck, finger, wrist and so on. It is very costly for a merchant to carry jewelry articles such as chokers, bracelets, anklets, finger rings and so on in different sizes and more often, such jewelry usually is available in only one or limited size ranges.

In the case of fingers, the joints of the fingers typically are larger than the intermediate portions. It is often difficult to remove a ring from a finger once it is attached due to the enlarged joint. The prior art has provided a number of solutions to this problem with respect to finger rings, none of which are satisfactory as explained below. In the case of wrists, if a bracelet is too small it can not be used by that person. The same is true of chokers which tend to closely fit about the neck. Thus many people who ordinarily would purchase such jewelry articles do not because of fit problems. Also, it is desirable that such articles do not appear to be flexible and expandable because such appearance may detract from the value of the article. People may not like to associate fine costly jewelry with visible linkages.

U.S. Pat. No. 668 discloses a finger ring wherein a linkage arrangement is provided which permits the ring finger size to expand. Gems may be placed on the links or the ring may be plain. The links are arranged as a series of symmetrical interconnected four bar linkages. The links are externally visible and thus detract from the appearance of the ring. Also such links may also pinch in certain instances.

U.S. Pat. No. 1,079,489 discloses an expandable finger ring including a curved rod pivotally attached to a relatively enlarged squared section link at a rod enlarged head section. The link is pivoted to an enlarged base section. The base section is pivoted to a connecting portion which extends for about 120°. The other end of the rod receives a lug which captures a spring to the head section. Two sets of such sections are located on opposite sides of the decorative element of the ring. These sections take up about 25% of the ring periphery. The rod and square links are located inside of a hollow portion of the ring sections which hollow portion extends about the ring center for about 25% of the ring. Numerous pivots and complex shapes are required. The ring sections separate as the ring is passed over an enlarged portion of a finger and return over a smaller portion of the finger. The ring is formed of numerous differing sections which are not arranged to receive gemstones and are costly to fabricate and assemble.

U.S. Pat. No. 1,018,663 discloses an expandable ring comprising outer links between which is sandwiched an inner link. All of the links are elongated and arcuate. The inner link has an arcuate slot. Two pins are attached to the outer links and extend across the spacing between the two outer links. The pins pass through the slot of an inner link. A spring is in the inner link slot and between each pin and the end of the inner link slot. The outer links thus can resiliently move apart wherein the pins in the inner link slot move to compress their respective springs as the ring is expanded. The links are not arranged to receive gemstones. The outer links appear as such and thus detract from the visual appearance of the ring. This structure also has numerous components and is costly to implement.

U.S. Pat. No. 2,902,749 discloses an expandable ring comprising a plurality of complex sections linked together by an elongated spring threaded through all of the sections. The sections have pins which slidably and pivotally engage slots in the next adjacent sections. The sections are H shaped with a center guide member having a bore for receiving the spring and inwardly extending pins at the end of each leg of the H for engaging the slots of the next section, the sections alternating in an annular array. These next sections have a plate and spaced resilient jaws forming the slots with the plate and a central body with an elongated bore for receiving the spring. This too is a complex and costly arrangement. Thus the above patents disclose costly and complex structures which also have limited flexibility in design or are relatively unsightly.

A need is seen by the present inventors for a solution to these problems including provide a relatively low cost flexible jewelry linkage arrangement and also provide jewelry segments that do not detract from the visual appearance of the jewelry article.

A flexible linkage for a jewelry article according to the present invention comprises an aesthetically pleasing jewelry element and an adjacent aesthetically pleasing jewelry segment having an annular wall for forming at least a portion of the article, the segment having a hollow internal region, the annular wall forming a side wall with a bore therethrough in communication with the internal region. A first elongated member is secured to and extending outwardly from the element, the elongated member passing through the bore into the hollow internal region of the segment; and includes a spring secured to the elongated member in the hollow region of the segment for resiliently urging the segment toward the element while permitting the segment and element to resiliently move away from each other.

In one aspect, the segment is arranged to receive a gemstone.

In a further aspect, the segment is arranged to receive decorative indicia thereon.

In a further aspect, the segment has an enlarged boss in the hollow region, the boss having the bore therethrough.

In a further aspect, the elongated member is closely received in the bore for substantially precluding transverse wobble of the segment and element relative to each other.

In a further aspect, the elongated member defines an axis at the bore, the hollow region of the segment is open to the ambient atmosphere in a direction transverse to the axis in two opposing directions.

In a further aspect, the segment is formed as a gem receiving setting.

In a further aspect, the segment and element are arranged in an annular array of a plurality of segments on a circular axis lying in a plane, the elongated member being offset from the axis transversely to the plane.

In a further aspect, a second elongated member is included offset from the axis on a side of the plane opposite the first elongated member.

In a further aspect, the first and second elongated members alternate in a direction extending about the annular array.

In a further aspect, the elongated member is a pin with an enlarged head at each end.

In a further aspect, the elongated member is a threaded stud with a head at one end and a nut at the other end, the head and nut for capturing the member to the adjacent element and segment In a further aspect, the element and segment are identical.

In a further aspect, the elongated member has a transverse bore in each end and including a fastener in the transverse bore for capturing the elongated member to one of the segments in the hollow region.

In a further aspect, a plurality of segments and a plurality of the first elongated members are included wherein the plurality of first members are aligned in a plane.

In a further aspect, the article is any one of a finger ring, a bracelet, an anklet, a necklace and a brooch.

In a further aspect, the element is a segment, the segments are each generally annular with a hollow core forming the hollow region.

A method of making a jewelry article according to the present invention comprises forming a plurality of adjacent segments abutting each other at a web region forming a one piece rigid integral unit, separating the segments, and then resiliently attaching the separate segments adjacent to each other to form them into the article.

In a further aspect, the forming the adjacent segments comprises casting the plurality of segments.

In a further aspect, the casting step includes casting the one piece integral unit of a jewelry metal composition.

In a further aspect, the method includes forming a plurality of rods with the at least one of the segments to form a gemstone setting with that at least one segment.

In a further aspect, at least one of the segments has a hollow core. Preferably, in a further aspect, a majority of the segments have a hollow core. In a further aspect, the segments are identical, each having a hollow core.

In a further aspect, a flexible linkage for a jewelry article comprises an aesthetically pleasing jewelry element and an adjacent aesthetically pleasing jewelry segment for forming at least a portion of the article, the segment having a hollow internal region and a side wall with a bore therethrough in communication with the internal region. A first elongated member is one of fixedly or resiliently secured to and extends outwardly from the element, the elongated member passing through the bore into the hollow internal region of the segment. A spring is secured to the elongated member in the hollow region of the segment for resiliently urging the segment toward the element while permitting the segment and element to resiliently move away from each other.

In a still further aspect, a method of making an aesthetic pleasing jewelry article comprises forming a plurality of elements at least one of which elements is a molded one piece hollow core member with integral monolithic gemstone setting rods employing a CAD/CAM metal mold forming process and resiliently securing the plurality of elements together, each element being adjacent to a further element to form the article.

IN THE DRAWING

Figure 5:
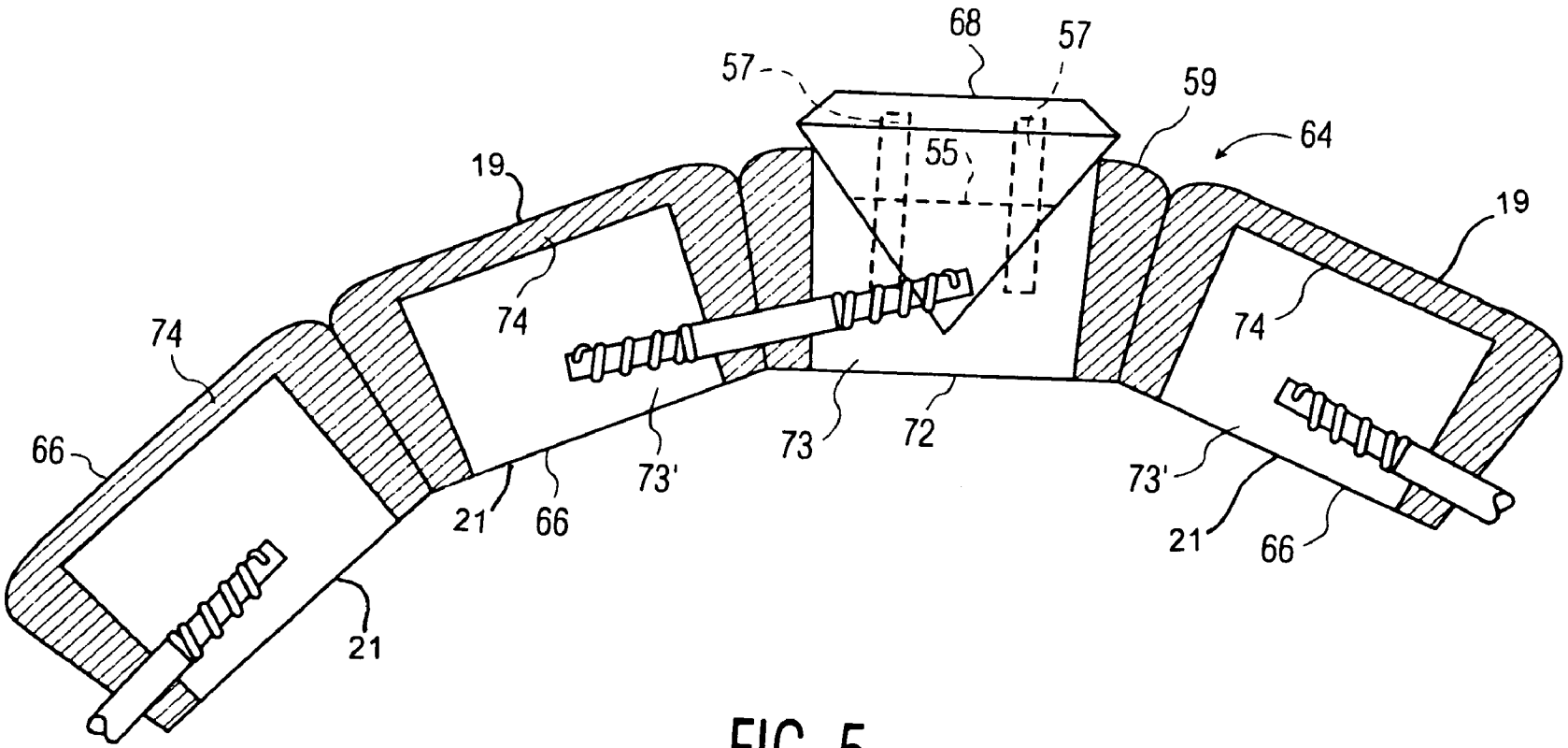
FIG. 5 is a side elevation sectional view of a portion of a ring according to a second embodiment of the present invention.
Figure 5A:
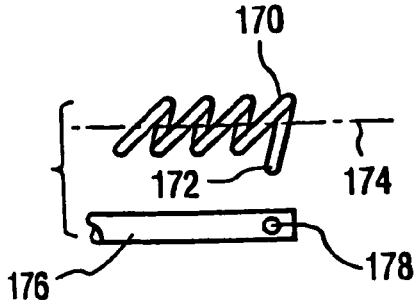
Figure 5B:
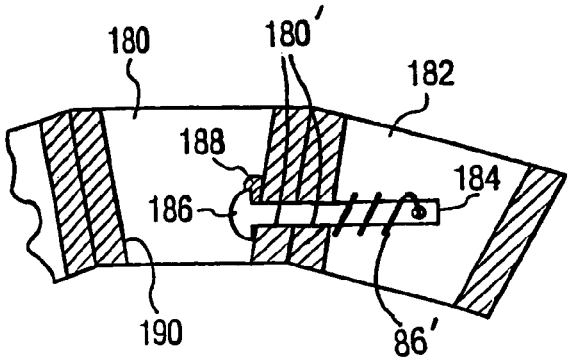
Figure 6:
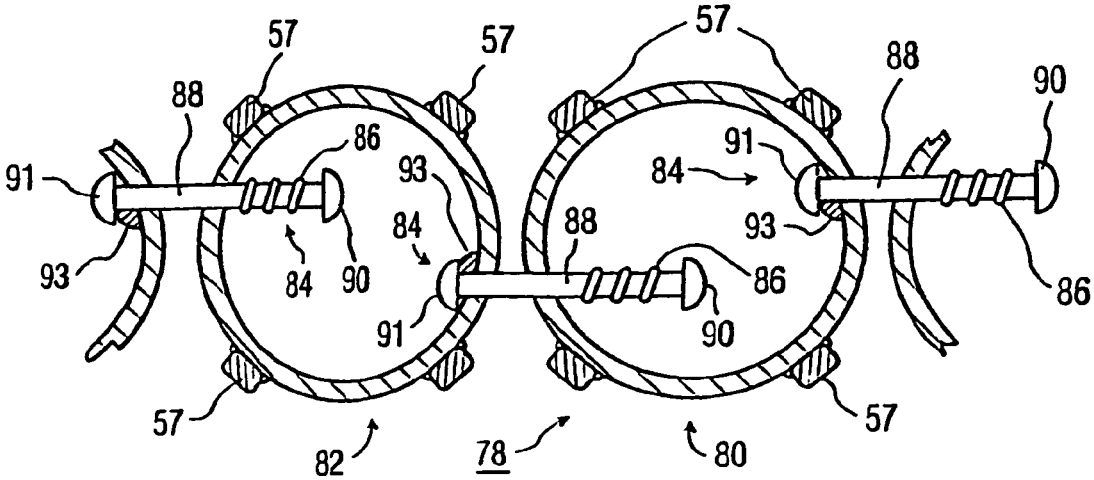
Figure 7:
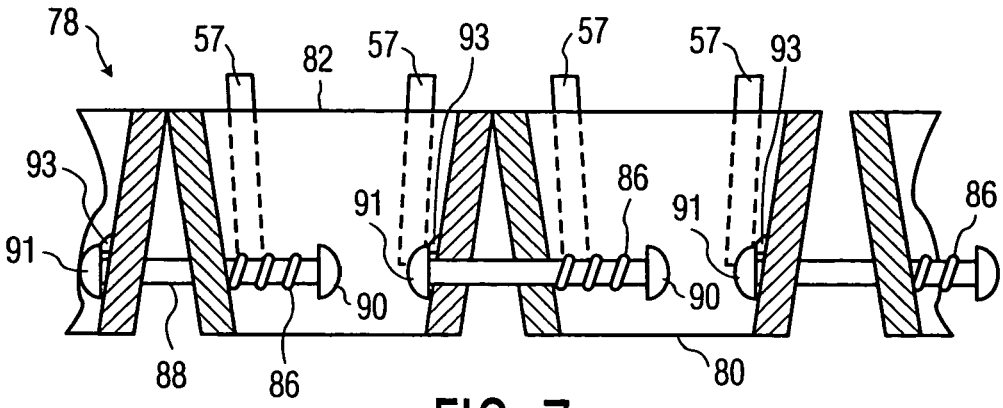
Figure 8:
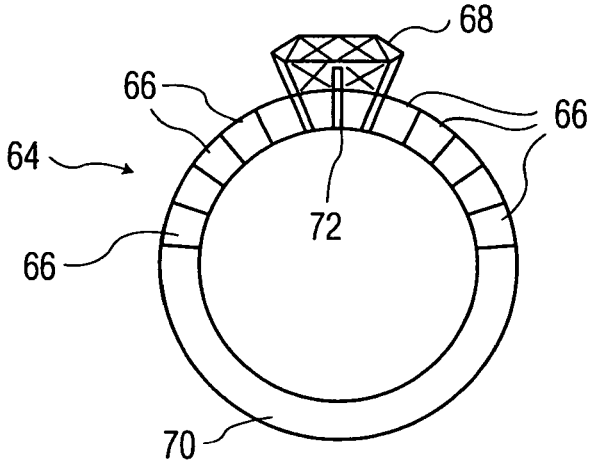
Figure 9:
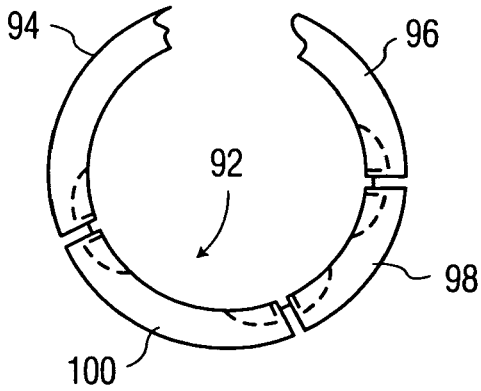
Figure 10:
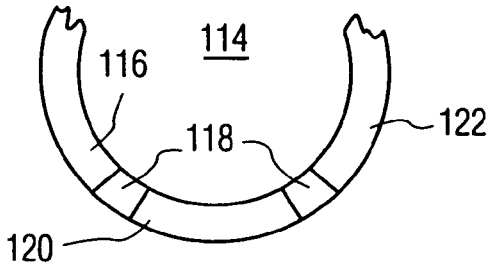
Figure 11:
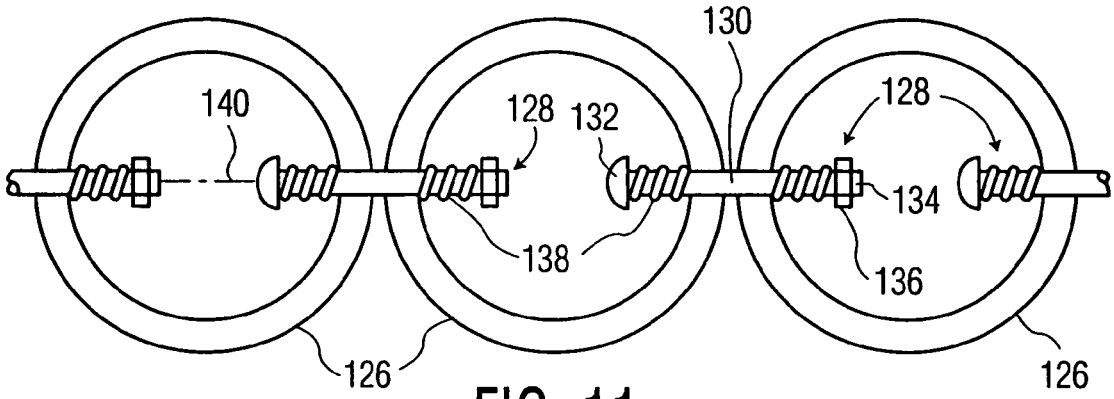
Figure 12:
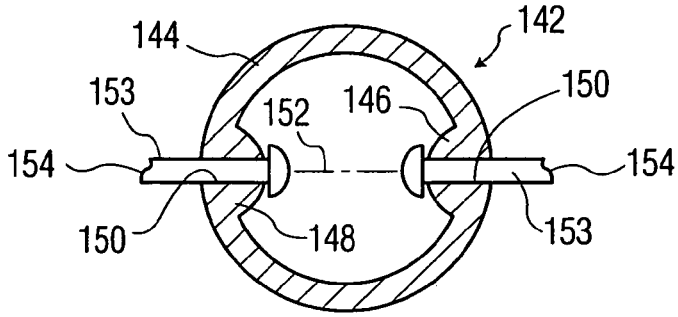
Figure 13:
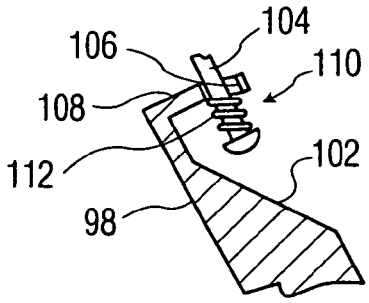
Figure 14:
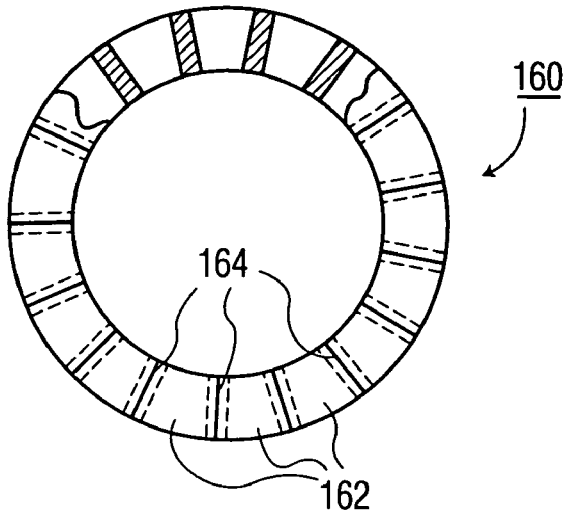
Figure 15:
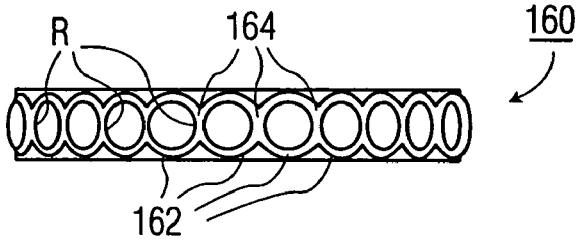
Figure 16:
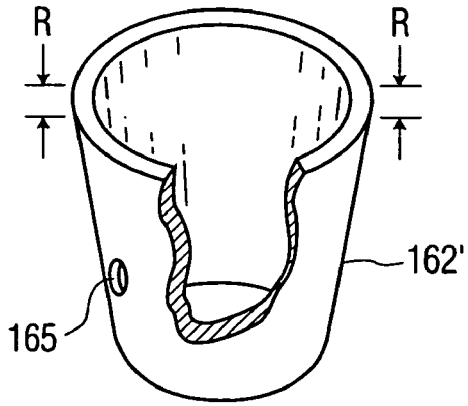
Figure 17:
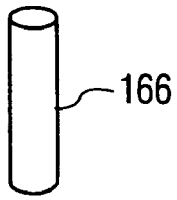
Figure 17A:
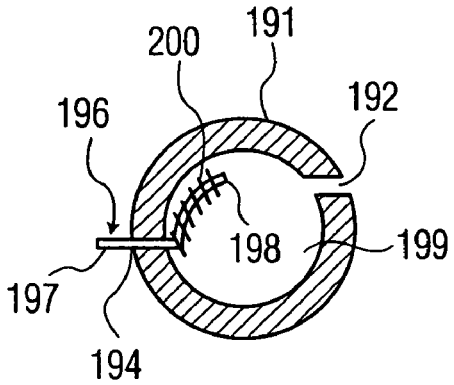
Figure 18:
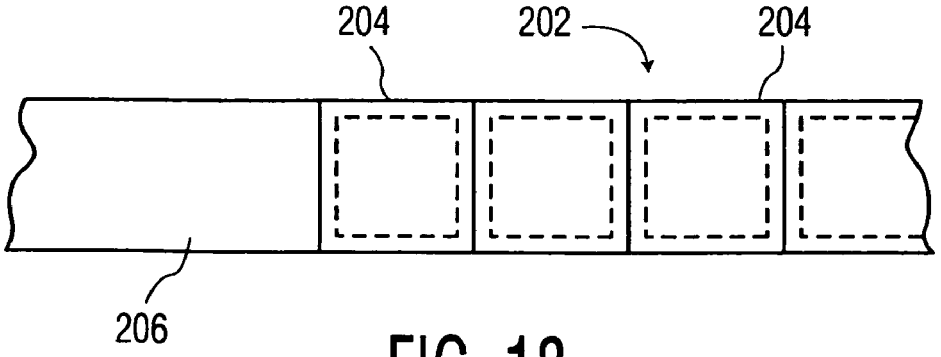
Figure 19:
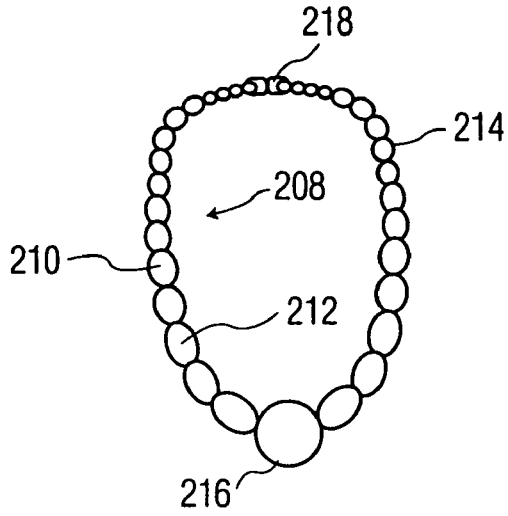
Figure 20:
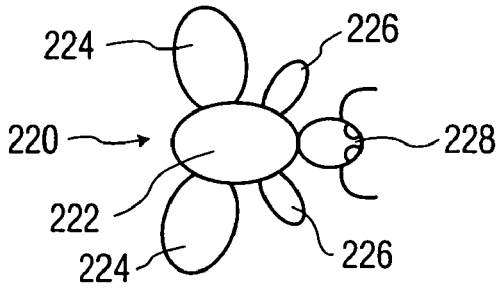
Figure 21:
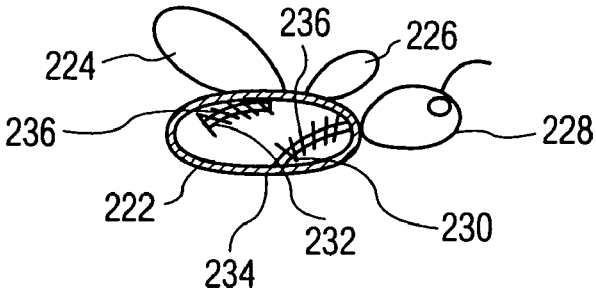
Figure 22:
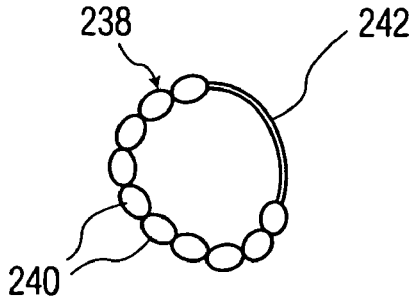
Figure 23:
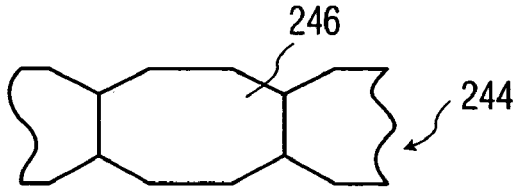
Figure 24:
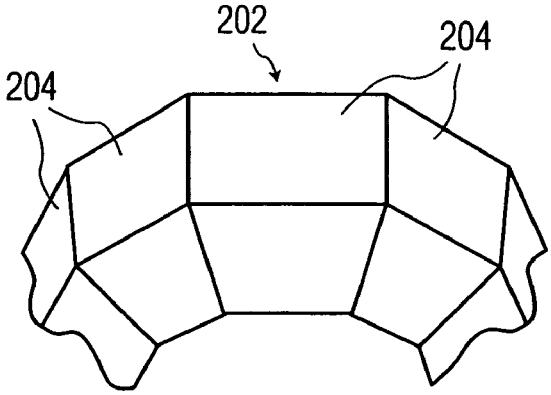
Figure 25:
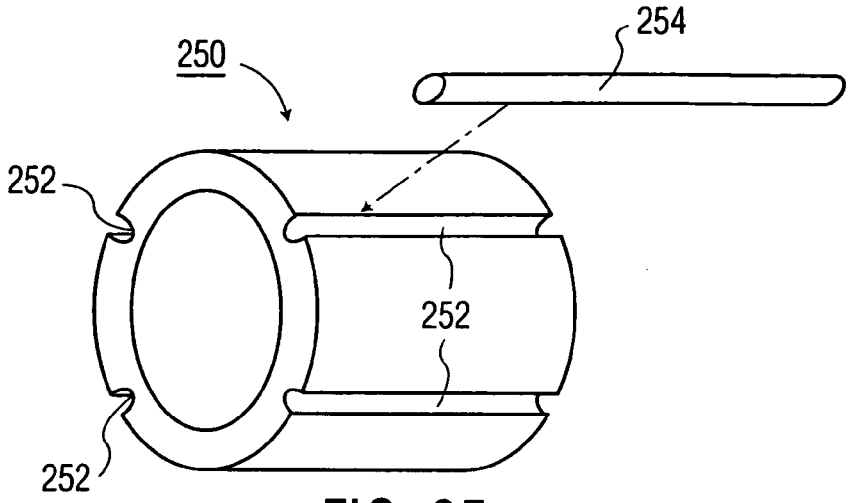
Figure 26:
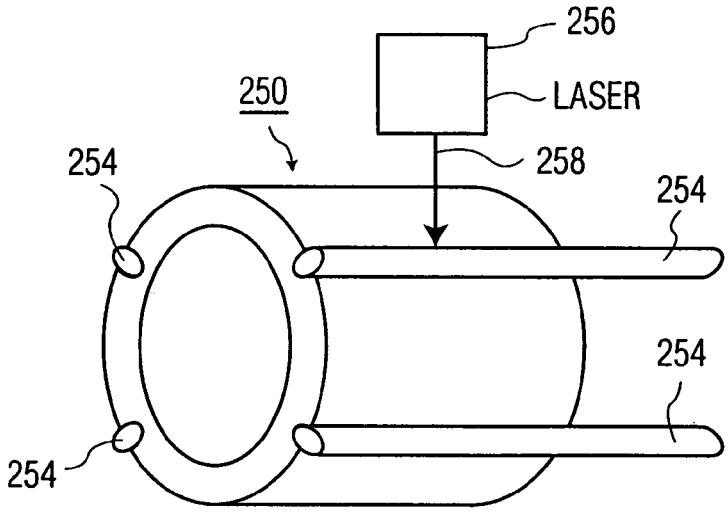
Figure 27:
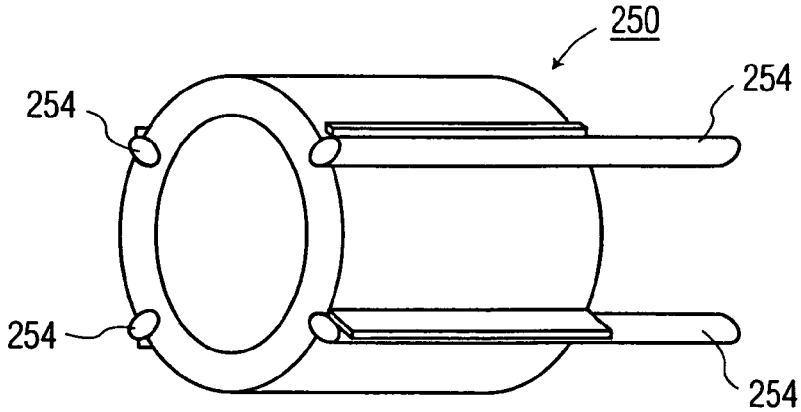
Figure 28:
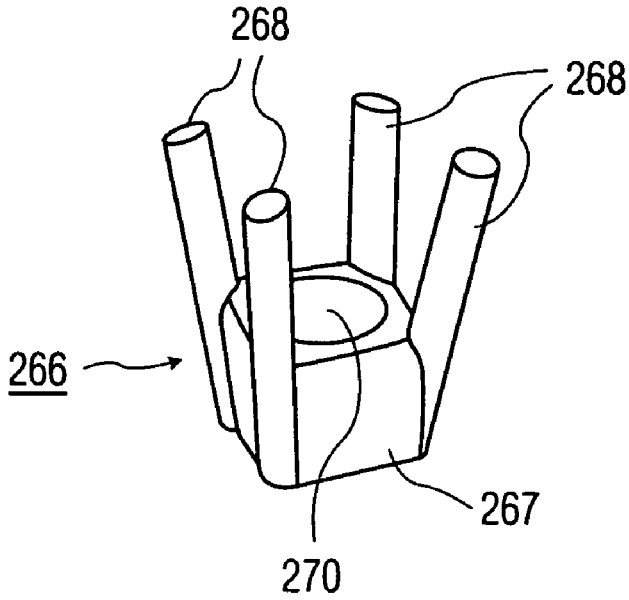
Figure 29:
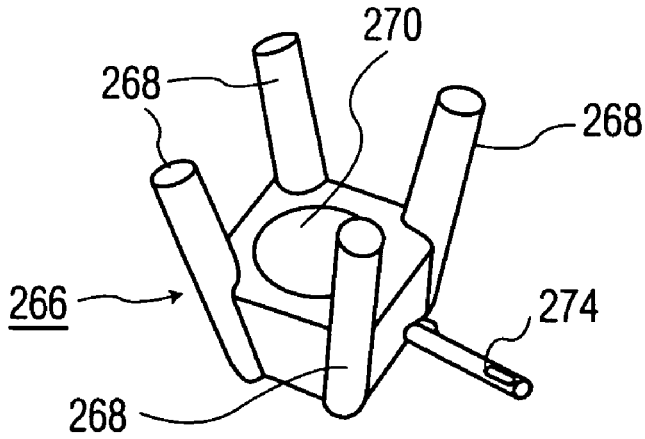
Figure 30:
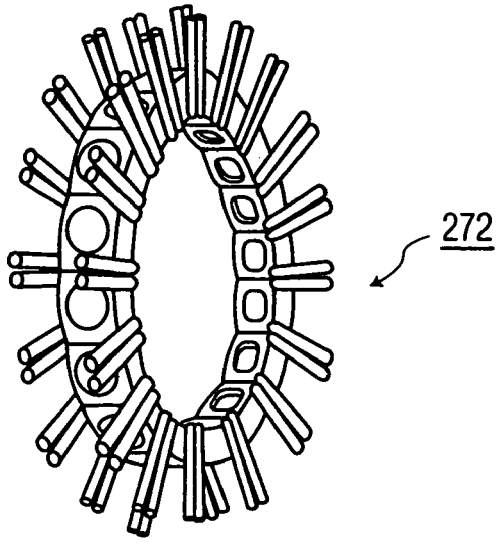
Figure 31:
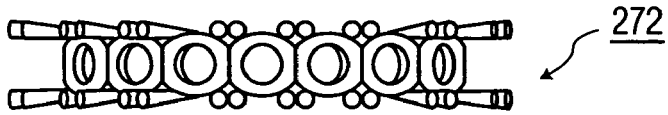

FIG. 5*a* is an exploded side elevation view of a spring and pin in accordance with an embodiment thereof;

FIG. 5*b* is a sectional side elevation view of ring segments and pin connection according to a further embodiment;

FIG. 6 is a sectional plan view of a portion of a ring arranged as a linear array of segments for purposes of illustration according to a further embodiment;

FIG. 7 a side elevation sectional view of the ring portion of FIG. 6;

FIG. 8 is a front elevation view of a ring according to a further embodiment;

FIG. 9 is a front elevation view of a portion of airing according to a further embodiment of the present invention FIG. 10 is a fragmented front elevation view of the ring according to a further embodiment of the present invention;

FIG. 11 is a plan sectional view of a ring portion arranged in a linear array for purposes of illustration according to a further embodiment of the present invention;

FIG. 12 is a plan sectional view of a representative ring segment according to a further embodiment of the present invention;

FIG. 13 is a side sectional elevation view of a portion of a ring segment of the ring of FIG. 9;

FIG. 14 is a side elevation view of a casting of a ring in an intermediate stage of fabrication of the embodiment of FIGS. 6 and 7;

FIG. 15 is a top plan view of the casting of FIG. 14;

FIG. 16 is an isometric view partially in section of one of the segments of the embodiment of FIGS. 14 and 15 after separation from the adjacent segments;

FIG. 17 is an isometric view of a rod for use with the segments to form the segment into a gem receiving setting;

FIG. 17*a* is a top plan sectional view of a segment according to a further embodiment of the present invention;

FIG. 18 is a top plan view of a jewelry bracelet;

FIG. 19 is a top plan view of a necklace;

FIGS. 20 and 21 are respective top plan and elevation sectional views of a brooch;

FIG. 22 is a top plan view of another embodiment of a jewelry bracelet;

FIG. 23 is a fragmented top plan view an alternative embodiment of elements arranged in flexible interconnected linkages;

FIG. 24 is a fragmented isometric view of a portion of a bracelet according to the embodiment of FIG. 18;

FIGS. 25-27 illustrate various stages of a representative attachment of the gemstone setting rods to a finger ring segment;

FIG. 28 is a perspective view of a finger ring segment according to a further embodiment;

FIG. 29 is a perspective view of the finger ring segment of FIG. 28 with a link pin attached for resilient coupling to a next adjacent segment;

FIG. 30 is a perspective view of a finger ring utilizing the segments of FIGS. 28 and 29 without the gemstones attached;

FIG. 31 is a plan view of the finger ring of FIG. 30; and

Figure 32:
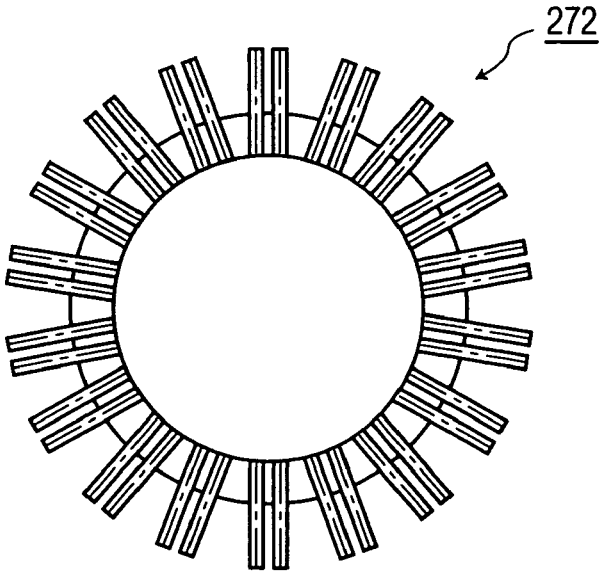

FIG. 32 is a side elevation view of the finger ring of FIG. 30.

DEFINITIONS

Secure—The term secure as used herein means to fixedly or rigidly make firm or fast by attaching or to movably attach.

Pin—An elongated slender member of cylindrical or any other cross section configuration of any length made of wood, metal, plastic or other stiff materials and the like used to fasten, support or hold things together.

Jewelry—An article of gold, silver, platinum or other fine metals or a base material with or without a coating and/or having an attractive exterior finish with or without precious or semiprecious stones and with or without decorative art work and used for adornment.

Element—A jewelry member which is formed as a portion of a jewelry article and may include segment.

Segment—A discrete unit of a jewelry article having a hollow core and resiliently attached to a next adjacent member by an elongated member and a spring.

Figure 1:
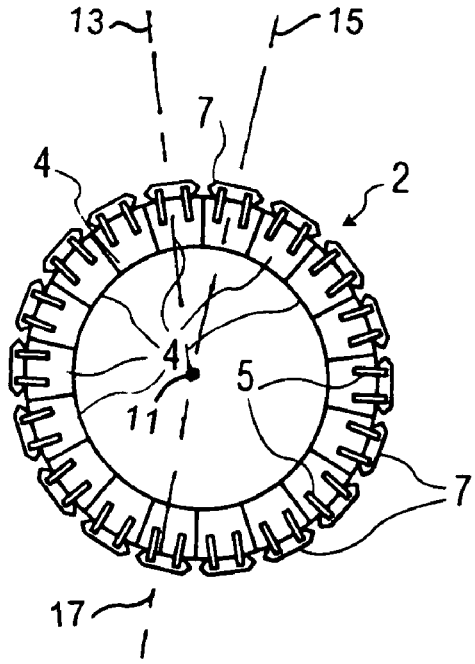
FIG. 1 is a front elevation view of a finger ring according to an embodiment of the present invention.
Figure 2:
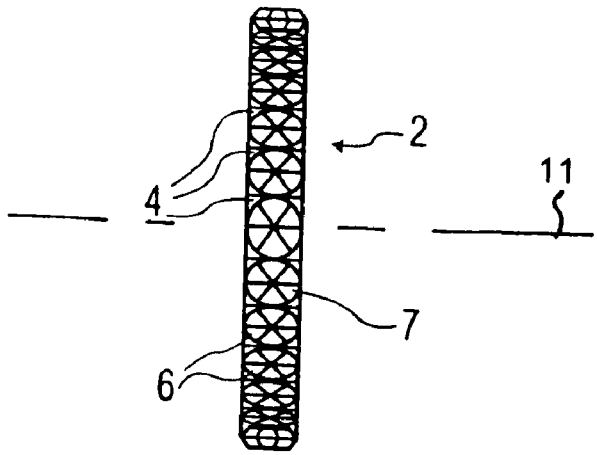
FIG. 2 is a side elevation view of the ring of FIG. 1.
Figure 3:
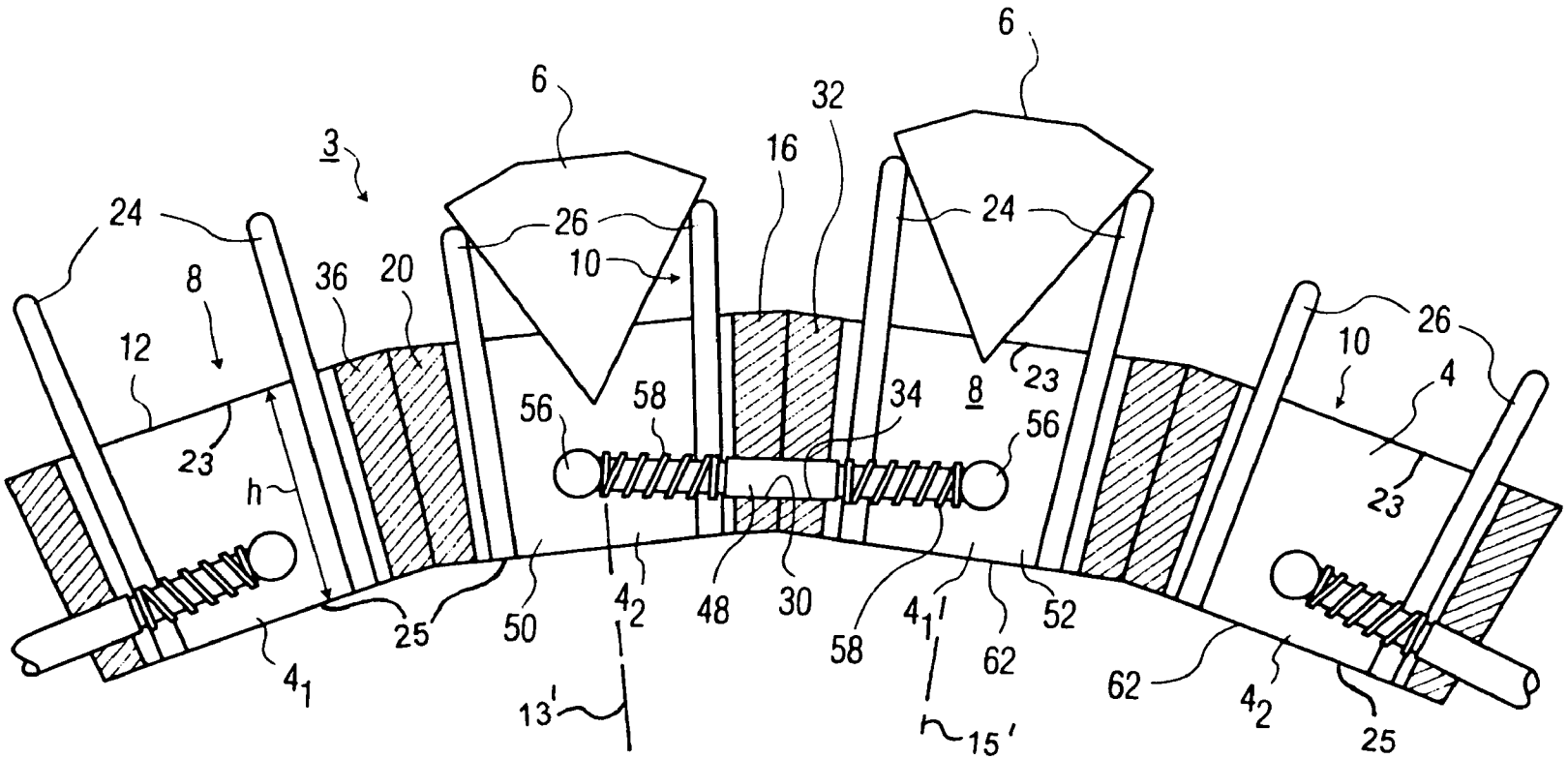
FIG. 3 is a more detailed front elevation sectional view of a portion of the ring of FIG. 1.

In FIGS. 1 and 2, a jewelry finger ring 2, in an exemplary first embodiment, has a plurality of hollow core annular segments 4, which are preferably generally frusto-conical cylinders, and extend about the ring in abutting relationship in their normal quiescent position. The segments 4 of the ring 2 are in an annular array that defines a central axis 11 that is normal to the plane of the drawing sheet. Each segment is a frusto-conical cylinder with a hollow core in this example, preferably in this embodiment of the same general diametrical, height and thickness dimensions and is formed as a gemstone setting with identical gemstone setting rods 5 soldered or welded to the segments on their external surfaces. The generally cylindrical segments 4 each define a radial axis such as axes 13, 15, 17 and so on. These radial axes emanate radially from the central axis 11. The hollow core segments 4 and rods 5 receive a diamond gemstone 6 or other gem or decorative stone. The stones 6 may be the same or different. In the alternative, decorative indicia such as enameled decorations may be applied to the outer surfaces of the radially outwardly facing faces of the segments such as faces 19, of the segments 66, FIG. 5, or other art works, not shown, may be attached to or formed integral with the outwardly facing face 19 of each segment 4. The radially outwardly facing faces 19 are normal to and thus transverse to the radial axis of the segments such as axes 13, 15, 17 (FIG. 1). The radially inwardly facing faces 21 of segments 66, FIG. 5, are open to the hollow interior core. In FIG. 3, the radially outwardly facing faces 23 and the radially inwardly facing faces 25 are open to the segment interior core similar to the radially inward faces 21 of segments 66, FIG. 5. In FIG. 3, the segment 50 lies on radial axis 13' and the segment 62 lies on radial axis 15', both axes emanating from the segment array central axis such as axis 11, FIG. 1 (not shown in FIG. 3). In a further alternative, the segments may be plain through out or combined with gems or other art works on their outer regions. The rods 5 are also optional for this reason. The segments 4 and stones 6 are set in a uniform annular array in the FIG. 1 embodiment, i.e., that is the segments are identical and are at equal abutting relation to form an aesthetically pleasing ring with each other and of generally the same size. The stones 6 are positioned in this embodiment slightly above each segment at the same general position.

In FIG. 3, in a further embodiment, by way of example and illustration, the jewelry finger ring 3 has settings 8 and 10 and respective segments $\mathbf{4}_1$ and $\mathbf{4}_2$ corresponding to the settings 8 and 10. The settings and segments are preferably formed of jewelry metal such as platinum or an alloy thereof, but may be other metals or a base material plated or coated with rhodium, a white metal, gold, silver and so on or non-metal base materials as desired, with or without a coating. The settings 8 include rods 24 and the settings 10 include rods 26. The rods are preferably wires formed of a platinum alloy. The rods 24 and 26 in this example extend at different heights above the ring outer periphery surface 12 formed by the respective segments $\mathbf{4}_1$ and $\mathbf{4}_2$. Each segment and its rods together form a setting 8 or 10 for a precious or semi-precious gem or other stone or decorative element. The segments $\mathbf{4}_1$ and $\mathbf{4}_2$ without the rods are preferably identical in outer dimensions and thickness. The segments may have any outer peripheral shape, such as circular in the form of frusto-conical, square, rectangular or a polygon of any regular or irregular shape. The segments $\mathbf{4}_1$ and $\mathbf{4}_2$ are preferably as shown in this embodiment annular frusto-conical cylinders or rings, FIG. 4. A representative segment $\mathbf{4}_1$, FIG. 4, in one embodiment comprises four sections 14, 16, 18 and 20 of equal angular extent in directions 22. Each section 14-20 is of the same height h, FIG. 3. The sections and rods are preferably metal and are of any desired material such as 95% platinum alloy or other white metal, or alloys of known compositions as used in the jewelry art or any other suitable materials such as other metals, plastics, and synthetic materials. For example, a preferred composition is disclosed in commonly owned U.S. Pat. No. 6,071,471 incorporated herein by reference. The sections are preferably cast and/or machined or fabricated according to any known technique according to a given implementation.

Figure 4:
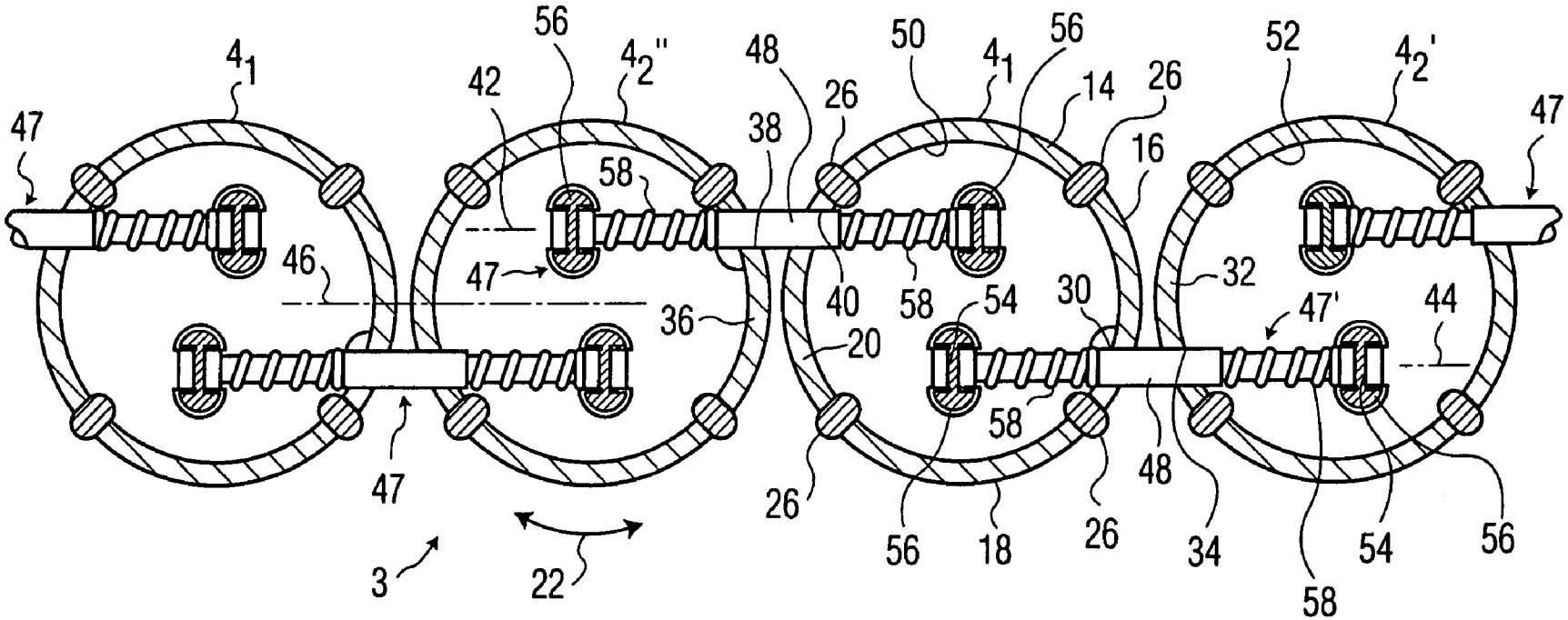
FIG. 4 is a plan sectional view of a portion of the ring of FIG. 1 arranged as a linear array of segments for purposes of illustration.

The settings 8 are each respectively formed with identical rods 24 as shown in FIGS. 3 and 4. The settings 10 are each preferably formed with identical rods 26 shorter than rods 24, in this embodiment, as shown in FIG. 3. The rods 24 of settings 8 are taller than the rods of settings 10 so that the gemstones 6 are at different heights about the ring outer surface 12. This is optional as all rods of all of the settings may also be of the same height, for example, the height of settings 8 or 10 or any other configuration, as shown in FIGS. 1 and 5, for example. Many different types of precious or semi-precious stone setting configurations may be employed for a given implementation as known in the jewelry art.

The rods 26 of representative segment $\mathbf{4}_2$, FIG. 4, are welded, soldered, brazed or otherwise bonded to or affixed to and between the sections 14, 16, 18 and 20, and optionally and may be cast one piece therewith.

The rods are preferably platinum alloy wires that are brazed to the platinum segments as explained below in connection with FIGS. 25-27, which segments are formed as one piece castings as explained below in connection with FIGS. 14-16. The settings 8 and 10 are preferably made of identical metals. The segments, in the alternative, may be cast together as a one piece integral unit to form each segment and then later separated as discussed below in connection with FIGS. 14-16. In a further alternative, the rods and each frusto-conical segment may be cast as a one piece setting. The segments and rods preferably have rounded corners, which is optional. The setting configuration is also optional as other configurations may also be used. Also, a plain jewelry finger ring thus would not have any rods or settings. In such a plain ring, the segments may of uniform or equal size or of different circumferential lengths and enclosed at the outer exposed surfaces.

While the segments $4_1$, $4_2$ are shown as frusto-conical rings in FIG. 4 they may have other geometrical shapes as desired such as square, rectangular, oval, elliptical and may include complex surfaces with surface features such as grooves or engravings, and include art work images in enamel and so on as commonly employed in the jewelry art. Additional artistic elements may be added to the segments such as cameos, frescos, decorative elements and so on. The segments may also have rounded cylindrical outside surfaces so that the ring appears in toto as an annular tube or rod as in conventional solid rings of this type.

In FIGS. 14 and 15, the segments 162, in an alternative embodiment, may be cast as a single integral intermediate stage ring 160. The ring 160 is formed with a plurality of frusto-conical segments 162 wherein adjacent segments are joined together as one piece by webs 164. The segments are each identical or substantially identical in this embodiment. The segments 162 are then separated by cutting the webs with a saw or like tool and then finely finished at the cuts, regions R, FIG. 16, to provide an aesthetic pleasing annular appearance as segment 162'. Any cutting instrumentation or technique may be used to separate the segments. This process insures that all of the segments so cut from an annular ring together can be rejoined in the flexible segmented ring as a whole.

A bore 165, FIG. 16, may be then formed on opposite sides in offset relation relative to the center axis of the segment hollow core as shown for example by the bores 30 and 40, FIG. 4. A set of four, or more or less as desired, of rods 166, FIG. 17 are then brazed to the exterior surface of the segment(s) to form the setting with the segments for receiving a gemstone.

In FIGS. 25-27, by way of example segment 250, formed of platinum, is cast originally as part of a ring casting as shown and explained in connection with FIGS. 14-17 above. The segments are then separated as discussed. In this embodiment, the segment 250, which is representative of all of the segments of this ring, is shown as circular cylindrical for purposes of illustration but is preferably frusto-conical. In this embodiment the segment 250 is formed with an annular array of four identical semi-circular cylindrical grooves 252, which are optional. These grooves extend along the external surface of the segment and are cast into the segment.

A set of four platinum alloy wires 254, one being shown in FIG. 25, are complementary diametrically dimensioned to the grooves diametrical dimensions so each wire will nest in its corresponding groove. The wires 254, FIG. 26, are then laser tack welded to the segment 250 by a laser 256. The laser beam 258 tack welds the wire at desired location on the wire to temporarily secure the wires 254 to the segment. In FIG. 27, a shim 260 of platinum material has a melt temperature of about 1110° C. The shim 260 may be of any shape, but is shown as an elongated rectangular strip of sheet metal. The shim 260 is used to braze the wires 254 to the segment 250. A shim 260 is placed adjacent to the junction of each wire 254 and segment 250. The shims 260 may be preferably tack welded in place by the laser 256.

The segments 250 with the attached wires 254 and shims 260 are then placed in an oven (not shown) in an orientation, such as that shown in FIG. 27, that permits the shim material when molten, to flow into the junction between the wires 254 and the segment 250. The interior of the oven has a temperature of about 1100° C. The segment with the attached wires and shims is left in the oven for a time period sufficient to melt the shims. The molten shims flow into their junctions with the segment 250. The assembly is removed from the oven and cooled.

By initially casting the segments as an integral one piece ring, it is assured that all segments from this ring after separation will match to form the finished ring product. This method of forming the segments is preferred as compared to the embodiment of FIG. 3 wherein each segment is formed of sections, which is more costly and difficult to fabricate and thus is less desirable.

In FIGS. 3 and 4, the segments are described as comprising sections for purposes of illustration only, it being understood from the above that the segments are preferably cast one piece as described. Section 16 of representative segment $4_1$ has a bore 30 therethrough. The next adjacent segment $4_2'$ on one side of segment $4_1$ has a section 32 with a bore 34 therethrough. Section 32 preferably abuts section 16. The bores 30 and 34 are preferably identical and axially aligned on axis 44, FIG. 4, to form a continuous bore with each other.

The next adjacent segment $4_2''$, FIG. 4, on the other side of segment $4_1$ has a section 36 with a bore 38 therethrough. Section 20 of segment $4_1$ has a through bore 40 that is axially aligned with the bore 38 on axis 42 that is parallel to the axis 44 of bores 30 and 34. The axes 42 and 44 are preferably equally spaced from and offset with respect to the central plane 46 of the ring. Section 36 preferably abuts section 20. The bores 38 and 40 are preferably identical and axially aligned to form a continuous bore with each other. The bores 38 and 40 are identical to the bores 30 and 34. All of the remaining segments of ring 2 are constructed with bores identical to the bores of segments $4_1$, $4_2'$ and $4_2''$.

A pin assembly 47 is associated with each pair of adjacent sections of the adjacent segments. Representative assembly 47', FIGS. 3 and 4, includes a circular cylindrical elongated metal pin 48, which may be rhodium plated carbon steel, located in the bores 30 and 34 and extends into the hollow region or core 50 of segment $4_1$ and hollow region or core 52 of segment $4_2'$. In FIG. 4, pin 48 has a through bore 54 at each end. The pin 48 is closely received in the segment bores 30 and 34 so as to minimize transverse wobble or displacement of the segments 4 and 4' relative to each in a direction generally transverse to the plane 46. Some wobble or displacement may be present. To this extent, the walls of the sections 16, 20, 32 and 36 and so on for all segments are sufficiently thick to prevent such wobble or displacement of the pin 48. However, the pin 48 is free to slide in the bores 30 and 34 with minimum undesirable sticking.

In the alternative, in a preferred embodiment, the pin 48 is welded or soldered to the section of one of the segments, e.g., section 32 in the interior of the segment $4_2'$ (or in the alternative at the exterior surface of the segment). The pin 48 is free to displace with respect to the next adjacent segment such as segment $4_1$. Where the pin is soldered or otherwise affixed to one of the segments, then no spring is required on the pin in that segment core since the segment and pin are in fixed rigid relationship to each other. Also, the bore in that segment for the permanently fixed pin while preferable, is optional, as the pin may be affixed to it by soldering or otherwise to the segment on the segment external surface.

A rivet 56 with a head at opposite ends, FIG. 3, in one embodiment, or a threaded stud with a head at one end and a nut on its other end, FIG. 11, in another embodiment, is located in each bore 54. The head and/or nut are enlarged elements relative to the bores in which the pin 48 is located.

The rivet 56 forms an enlarged element, which captures the pin to the segment sections 16 and 32 A compression coil spring 58 is on the pin 48 between the rivet 56 and the section 32 in core 52 of segment $\mathbf{4_2}$'. The spring 58 is for resiliently urging the segment $\mathbf{4_2}$' toward the segment $\mathbf{4_1}$ while permitting the segment $\mathbf{4_2}$' and segment $\mathbf{4_1}$ to resiliently move away from each other. The spring 58 is larger in diameter than the bores 30 and 40, FIG. 4. The spring 58 is thus captured between the rivet 56 and the corresponding outer peripheral side wall of section 16 or 20, segment $\mathbf{4_1}$ in the interior of the segment, FIG. 4, as best seen in FIG. 5*b*, for example. In FIG. 5*b*, the spring 86' is shown significantly larger in diameter than the corresponding bore 180' receiving pin 184. In some of the other embodiments such as in FIGS. 3 and 4, the spring is shown only slightly larger than the corresponding pin bore in the segment wall. This captured spring relationship is true for all embodiments. The spring 58 may be rhodium plated carbon steel. A like spring 58 is optionally on the pin 48 between the rivet 56 and the section 16 in the core 50 of the abutting adjacent segment $\mathbf{4_1}$. In this case the pin and each segment are in movable relation to each other.

Preferably, each segment can move relative to the next adjacent segment about 0.05-0.25 mm (0.002 to 0.01 inches). With 20-30 segments in a ring, then a total annular resilient play in the ring with respect to possible circumferential expansion is about 1-7.5 mm (0.040 to about 0.30 inches). The springs also have a spring rate such that the segments are held relatively tightly together such that a deliberate pulling force is required to separate the segments as compared to a casual slight force that might occur during normal use of the ring.

In similar fashion, a pin 48 is in bores 38 and 40 of respective sections 36 and 20 in the respective cores of segments $\mathbf{4_1}$' and 4. Springs 58 and rivets 56 are on the pin 48 associated with the bores 38 and 40.

In the alternative, in FIG. 5*a*, a spring may be affixed to a pin in a different construction. In FIG. 5*a*, spring 170 has a transverse bent end portion 172 that is normal to the spring longitudinal axis 174. The pin 176, corresponding to pin 48, FIG. 4, has a bore 178 therethrough at one end. The bore 178 receives the bent end portion 172 of the spring to capture the spring 170 to the interior wall surface of the segment through which the pin 176 passes in similar fashion as the pin 48, FIG. 4. The pin 176 is preferably also soldered to the segment wall of the next adjacent segment. In the case where the pin is soldered or otherwise rigidly attached to a segment wall, there is no spring on the pin in that segment since the pin is rigidly held in place to that segment, and a spring would serve no purpose in this case.

In FIG. 5*b*, in a further example, frusto-conical segments 180 and 182 are abutting. A pin 184 is connected to each segment. Pin 184 has a head 186 that is soldered by solder 188 to the segment 180 in its core 190. Next adjacent segment 182 is resilient with respect to segment 180 along the pin 184 longitudinal axis. The soldering of the pin 184 head 186 to segment 180 stiffens the connection and thus the segments relative to each other to minimize side to side wobble, although some resilient side play may be present.

A pair of pins, springs and rivets, FIG. 4, are associated with each segment of the ring 2 as described above for segments 4, 4' and $\mathbf{4_1}$'. The axes of the pins and associated section bores alternate about the ring on opposite sides of the plane 46 as shown in FIG. 4. Thus the pins are aligned in two parallel spaced apart annular arrays as shown on opposite sides of plane 46 (the arrays of segments in FIG. 4 are shown as oriented linear in a plane for simplicity of illustration, it being understood the segments are arranged in an annular array). The pins 48 have portions that extend into and located within the cores of the corresponding segments adjacent to the bottom edges 62 of each segment to allow room for the gemstone 6, FIG. 3, to be set into the core of the segment, as applicable. The cores of the segments are open at the top edge surfaces 12, FIG. 3, and bottom edges 62. However, the cores may also be enclosed at the top and optionally also at the bottom. As a result, the springs are internal the segment cores and are not externally visible. Due to the close spacing of the segments, the pins are also generally of minimal visibility in the spaces between the segments in the normal use of the ring.

In the alternative, instead of settings being associated with each segment, the top surfaces 12 may be fully enclosed and formed with no settings. These surfaces may be plain or decorated with any kind of decorative media.

In operation, as the ring 2 is passed over a finger (not shown), FIG. 1, the segments are free to separate and expand the ring central opening to pass over the finger joints to its final position on the finger. In addition, as the finger may increase in size over time within the limits of expansion of the ring, the ring will always fit on the finger by expanding or contracting as the case may be. The segments are free to displace relative to the next adjacent segment. This provides a total ring displacement as discussed above.

In the alternative to the settings of ring 3 being at alternating different heights above the segment surfaces 12, the settings may be at the same height as shown in FIG. 1 at the height shown also in FIG. 5.

In addition, as shown in FIGS. 5 and 8, ring 64 may have a plurality of segments 66 extending partially about the ring and a large portion 70 of the ring may be optionally one piece. Segment 72 may carry a gemstone 68 and the segments 66 may be fully enclosed by a wall 74 at the outer peripheral surface corresponding to surface 12, FIG. 3, to form a plain ring with a single solitaire gemstone 68 as in conventional rings. The walls of the segments 66 may be decorated as discussed above in the alternative or may be plain white metal such as platinum alloys or other metals. The pin assemblies 76 of FIG. 5 may be otherwise identical with the pin assemblies of FIGS. 3 and 4 or FIG. 5*b*. As shown, however, the springs are attached as explained in connection with FIG. 5*a* wherein a spring has an end portion bent at right angles to the pin longitudinal axis and passed through a bore in the pin end. This end portion may be crimped to secure it to the pin after insertion in the bore.

The embodiment of FIG. 5 shows the gemstone 68 having a major portion inserted into the hollow core 73 of the segment 72. The pins 75 are offset from the center of the adjacent segment hollow cores 73, 73' as shown in the embodiment of FIG. 4, pins 48. This offset permits the gemstone to sit in the core region between the pins without interference with the pins and springs. Of course, the gemstone may be foreshortened also as illustrated by the dashed line 55. The rods 57 forming the setting are also foreshortened as shown to project slightly above the surface 59 of the segment 72 an amount to secure the stone 68 thereto. The FIG. 1 embodiment of the ring 2 illustrates a ring with gemstones set similarly as stone 68, but with a stone in each setting formed by each segment about the ring. This forms an aesthetically pleasing wedding band type ring.

In FIGS. 6 and 7, in the alternative, ring 78 includes a plurality of pairs of alternating segments 80, 82. The segments may form the entire ring or part of the ring as discussed in connection with FIG. 8 and so on. The segments may be identical to those of the embodiment of FIGS. 3 and 4. The difference is that pin assemblies 84 include a single spring 86 associated with each pin 88. In addition, each pin has heads 90 and 91 at opposite ends, an enlarged member that may be in the form of a rivet head attached to the pin end or formed by swaging the pin at its end. In the alternative, the spring may be attached to the pin as shown in FIG. 5*a*. The pin heads 91 are preferably soldered or otherwise bonded to the corresponding segment by solder joint 93. The segments in the various embodiments are arranged in an annular array on a circular axis lying in a plane, such as plane 46, FIG. 4, the pins being offset from the axis transversely to the plane as shown in FIG. 4.

In FIG. 9, ring 92 is formed of segments 94, 96, 98 and 100 among others optionally. The segments may be of the same or different arcuate extents. Segments 98 and 100 are the same and segments 94 and 96 are the same and longer than segments 94 and 96. A further segment (not shown) for carrying a gemstone may be between segments 98 and 100.

In FIG. 13, representative segment 98 has a cavity 102. Cavity 102 has a shape that permits the insertion of pin 104 into bore 106 of wall 108. The pin 104 is part of assembly 110 that includes a spring 112. The pin assembly 110 is attached to a similar wall of the next adjacent segment 100 or 96, FIG. 9, which segments are configured with a similar cavity and wall. The remainder of the segment is solid or may be hollow, e.g., a hollow tube, or the like.

In FIG. 10, ring 114 comprises a plurality of segments 116, 118, 120 and 122 which are of different annular lengths. The segments are all interconnected with pins and springs as discussed in the above embodiments.

In FIG. 11, ring 124 has a plurality of identical one piece frusto-conical segments 126 with no gemstone rods. The ring 124 as in FIG. 4 is shown as a linear array of segments which normally are arranged in an annular array. The linear array is shown for simplicity of illustration. These segments are enclosed at their outer surfaces and may also be enclosed in their radially inward surfaces. These segments have identical bores which receive the pins 130 of pin assemblies 128 which are identical. The assemblies 128 include a pin 130 having an integral one piece head 132 and a threaded end 134 to which a nut 136 is threaded to the end 134. A spring 138 is captured between each head and each nut and the corresponding segment wall. The pins 130 are located in the central plane 140 of the ring 124.

In FIG. 12, in the alternative, a representative segment 142 has an annular wall 144 the majority of which is of uniform thickness. The wall 144 has two opposing bosses 146 and 148 of like dimensions which thicken the wall at these locations. A bore 150 is in each boss and passes through the wall 144. The two bores 150 are aligned on axis 152. The shaft 153 of a separate pin 154 is closely received in and passes through each bore. The pin 154 is captured to the wall 144 by a head at each end and includes a spring at least in the region between one of the heads and the adjacent segment wall of the corresponding segment in a manner discussed in the above embodiments. The thicker portion of the wall 144 at the bosses 148 serves to minimize wobbling of the pin 154 in the bore and yet permit the pin to slide along the bore surface as the ring segments are displaced away from each other as the ring expands. One of the heads not associated with a spring may be soldered to the corresponding segment wall.

In FIG. 17*a*, in the alternative, a segment 191 has a pair of bores 192 and 194 formed for receiving pins. A pin 196 has a straight portion 197 that passes through the bores of the adjacent segments and an arcuate bent portion 198 that is in the interior 199 of segment 191 core. A spring 200 is secured to the arcuate bent portion of the pin. This leaves the center hollow region of the segment free to receive a gemstone (not shown).

The resulting jewelry finger ring such as ring 2, FIG. 1, is pleasing to the eye in that all segments are abutting or are in such closed proximity within a fraction of a mm or fraction of an inch, e.g., 0.125 mm (0.005 inches) or less, that they appear to the eye to abut with no space therebetween. Yet the segments in their entirety about the ring have sufficient expansion play therebetween to move resiliently relative to each other and behave as a stiff elastic band permitting the ring to flex annularly as it is inserted on a finger. The amount of displacement of the segments is relatively small so that the ring when on a finger appears to be a solid one piece unit with the segments appearing to be integral and joined as one piece. This arrangement provides an improved flexible ring for use with different size fingers. The ring may be fabricated in different size inner diameters to accommodate fingers of significantly different sizes. Thus there has been shown by way of example, in several embodiments, a flexible jewelry finger ring that accommodates different finger sizes while having an aesthetically pleasing appearance to an observer.

While the above embodiments relate to finger rings, the present invention also may be employed with other jewelry articles such as jewelry pins, brooches, bracelets, anklets, necklaces and any other type of jewelry article used for adornment.

With respect to bracelets, for example, often such articles, especially adorned with precious or semi-precious stones tend to be fabricated of a fixed circumferential dimension and will fit wrists only within a narrow range of such dimensions. Anklets also are widely popular wherein the jewelry article is fastened about the ankle. Necklaces too, of the type referred to as chokers, which closely encircle the neck, may only fit persons with necks of a maximum dimension. Such articles advantageously may also have linkages as described above herein which are flexible and which can expand to fit various circumferential body dimensions for adornment. Also, decorative jewelry pins may also have parts that are flexibly interconnected with flexible links as described herein to provide additional variation in such articles.

In FIG. 18, a bracelet 202 comprises identical hollow core (shown in phantom) square in outer peripheral shape segments 204. The segments are interconnected by flexible links similar to that shown in FIG. 7 comprising pins 88 and springs 86, it being understood that the segments of FIG. 7 are normally biased in contiguous abutting relationship by the springs as shown in FIG. 18 and that the spacing between the segments of FIG. 7 is created by forcefully separating the segments. In FIG. 18 the segments are shown in the flattened state but in use will normally be placed about a wrist. The segments 204 are connected to a single continuous connecting link element 206 which may be rigid or flexible. The bracelet thus can be expanded to fit about wrists of different sizes. The segments may also include settings for receiving gemstones. The element 206 may be replaced by an annular array of segments interconnected by pins and springs as described above using a single spring or two springs per pin in accordance with the amount of flexibility desired. Of course, the bracelet may also be arranged for use with the ankle forming an anklet as desired. To this end the segments are provided in sizes and shapes accordingly.

In FIG. 19, a necklace 208 is shown having segments 210, 212 and 214 among others of differing sizes and shapes. A central pendent 216 may be attached to the segments. A clasp 218 is provided for attaching the ends of the necklace in a typical arrangement.

In FIG. 20, a decorative pin or brooch 220 is in the form of an insect. The insect has a body 222 which has a hollow core (not shown). Wings 224 are attached to the body by bent pins 232 soldered to the wings 224 and extending outwardly therefrom. The head 228 is also attached to the body by a pin 230 soldered to the head and extending therefrom. The pins 230 and 232 may have the shape of pin 196, FIG. 18, and pass through bores in the hollow body 222 wall 234. A spring 236 is attached and captured to each pin as described in the above embodiments. In this way the head 228 and wings 224 are resilient relative to the body. The body thus forms a segment of an abstract shape which may be of any desired configuration.

In FIG. 22, a bracelet or anklet 238 comprises a plurality of oval segments 240. A single link element 242 is connected to the ends of the string of segments 240. The element and segments are all of jewelry grade materials metal or non-metals. Springs and pins (not shown) interconnect the element 242 to the adjacent segments and the segments to each other in a manner as described in the other embodiments.

In a further most preferred embodiment, a CAD/CAM system (Computer Aided Design/Computer Aided Machine, not shown) is used to create a machined metal positive master mold (not shown, but which is substantially identical to the segment 266, FIG. 28) for a single segment assembly comprising an annular segment corresponding to segment 267, FIG. 28, and attached gemstone setting rods corresponding to rods 268. By forming a mold with a CAD/CAM system, the mold may be made more precisely and thus identical with other similarly formed molds than with prior art manually formed molds, which typically might differ significantly from one another and thus not form an aesthetically pleasing annular ring. The resulting mold may be used to form substantially identical ring segments avoiding the need to form the segments initially as a cast annular ring of a plurality of segments as shown in FIGS. 14 and 15, for example. By machining the master mold of metal with a numerical control machine, a precision formed mold is fabricated to the desired tight tolerances so as to form a plurality of ring segment assemblies 267, FIG. 28, which fit exactly as desired in a given ring configuration. This is an improved, less costly manner of fabricating the segment and rod assemblies than that of FIGS. 14 and 15. This is because it is much less labor intensive. The CAD/CAM approach permits molding the setting rods to the segments and avoids the need to separately form and attach the setting rods as shown in FIGS. 25-27, an additional costly labor intensive process.

In FIG. 28, a plurality of rods 268, e.g., preferably four, one piece integral with each annular segment 267, formed as a representative monolith segment assembly 266, are formed from a mold created by a machined metal master mold created by the CAD/CAM system. A number of such master molds can be thus formed substantially identical to form a substantially identical plurality of segment assemblies of a given ring that fit together precisely. The so formed segment 267 has a hollow through core 270, which, with the rods 268 form a setting that receives a gemstone, for example, as shown in FIG. 5. Assembly 266 made by the CAD/CAM system created mold is most preferred to the above described embodiments. In the latter prior described embodiments, the rods and segments are formed separately and attached later by brazing or soldering for example, which is a relatively slower, costly and tedious labor intensive process.

The CAD/CAM system is a precise, accurate master metal mold design system in which the segments and rod molds are designed and machined, e.g., via a numerically controlled machined that is controlled by a computer system utilizing the design parameters created on the CAD system. This segment assembly master metal mold is used to form a single segment assembly 266 instead of an annular ring of annular segments as shown for example in FIGS. 14-15. However, such a one piece annular ring of a plurality of segments forming an annular array of segments and integral one piece rod mold may also be formed if desired by the CAD/CAM system as discussed below. In use of the latter mold, the segments of the final molded ring of precious metal are first separated and then later joined by resilient links such as link 274, FIG. 29, as explained above.

The annular ring of segments of FIGS. 14-15 is contemplated to insure that all segments of the ring will fit perfectly into an annular ring. If made separately with prior art casting techniques, it is believed that the segments if formed separately as molded individual segments, due to differences in the manually made different castings, would not accurately form a precise uniform set of segments that would be sufficiently identical to form the desired ring. It is believed that the manually molded individual segments might not fit together exactly, making it more difficult to form an aesthetic looking ring with identically fitting segments, requiring added labor intensive machining processes for making the segments fit as desired.

In the present most preferred embodiment, utilizing a CAD/CAM system, a mold of plaster of Paris, for example, is made from each of a plurality of accurately CAD/CAM machined metal segment assembly master molds. This plaster mold may, in the alternative, be formed of rubber or silicone as known in the mold fabrication art. Then a wax casting manifesting the assembly 266 is formed in the plaster mold. This wax casting is finished to produce a wax segment assembly having the final finished surfaces. A further plaster of Paris (or other material) negative mold is made with the finished wax positive molded ring. Then the wax is removed by burning or heating in what is referred to as a lost wax mold process leaving the negative mold with an empty hollow mold core. When the wax is removed, the latter plaster of Paris mold has a finely finished negative cavity in which the precious metal alloy segment assembly is cast to form the molded monolithic one piece segment and rod assembly 266.

In the alternative, a master tree mold may be fabricated comprising five to ten segment assembly molds, for example, or other quantities of segment assembly molds. The master tree mold is processed as described above for the single segment assembly master mold to form a finely finished negative mold for the molding of a number of segment assemblies 266.

A single metal positive mold is used to create multiple plaster molds or, in the alternative, a number of such metal positive molds are used to create multiple plaster molds. The master metal positive mold is formed using the CAD/CAM system and thus accurately forms a plurality of segment-rod assemblies which can be dimensioned to form a unitary finished precious metal ring setting.

It should be understood that not all annular segments so formed by the CAD/CAM system need to have rods attached. The rods as explained above are used as a setting for precious stones. In those segments in which such stones are not to be attached, then there is no need for the rods. Those segments are also fabricated from molds formed by the CAD/CAM system. By selectively using stone settings with non stone setting segments, a variety of different ring configurations can be provided using flexible links as described above. A single machined master mold of a segment, or of a segment-rod assembly, can be used for all segments forming a ring due to the precision of the CAD/CAM mold forming system. This system reduces three days of manual labor to form a ring as described in connection with FIGS. 14-15, and others of the figures, to a process that can be completed in a matter of hours. This latter process is significantly less manual labor intensive and thus less costly to implement.

In a still further embodiment, a master machined mold of a single ring of CAD/CAM machined of joined one piece annular segment assemblies may be formed. The process above using lost wax is repeated for each of the multiple segments of the ring mold. Precious metal segments and integral one piece monolithic rods are created from each individual segment mold of the machined mold ring as a separate unit and not as a joined molded ring. However, since the rods are preformed with the ring, the number of gemstones to be attached is to be predetermined. The segment assemblies of segments and rods are formed as individual assemblies as discussed above and each attached together with the resilient links 274, FIG. 29, to form a finished ring. A finished ring 272 (without the gemstones attached) is shown in FIGS. 30-32, wherein the individual segment assemblies are formed and joined with resilient links. The resilient links 274 may incorporate any of the link embodiments described above.

In FIG. 23, a bracelet or anklet 244 is formed of hollow segments 246 joined by springs. The segments are of a hexagon polygon cross section as by way of further example.

Thus there has been shown various embodiments of jewelry articles including segments alone or segments and elements interconnected by linkages comprising a pin which passes through a bore of at least one segment and including a spring captured to the pin in the core of the at least one segment to resiliently urge the segments or segment, element toward each other. The resultant jewelry article forms a decorative adornment for attachment about any circumferential body part or as a brooch. Decorative art work and or precious or semi-precious stones may be used as desired.

It will occur to one of ordinary skill that the disclosed embodiments are given by way of illustration and not limitation, and that various other modifications may be made to these embodiments. For example, the segments and adjacent elements may be of the same or different lengths. It is intended that the invention be defined by the appended claims.

What is claimed is:

1. A flexible linkage for a jewelry article including a plurality of linkage members forming an annular array at least during use of the article, the annular array defining a central axis, the linkage comprising:

at least one generally cylindrical jewelry element defining a first cylinder axis and an adjacent abutting generally cylindrical jewelry segment defining a second cylinder axis, the segment and element each having an outer peripheral curved wall respectively extending approximately the same extent about the corresponding first and second axes, at least the segment having a hollow internal region, said segment outer peripheral wall forming a side wall with a bore therethrough in communication with the internal region;

the element and segment forming a portion of the annular array of said linkage members, the first and second axes of the respective element and segment each comprising a radius emanating from the central axis;

a first elongated member secured to and extending outwardly from the element, the elongated member passing through the bore into the hollow internal region of the segment; and a spring secured to the elongated member in the hollow region of the segment for resiliently urging the segment toward the element in the abutting relationship with each other at their curved wall while permitting the segment and element to resiliently move away from each other.

2. The linkage of claim 1 wherein the segment is arranged to receive a gemstone.

3. The linkage of claim 1 wherein the segment is arranged to receive decorative indicia thereon.

4. The linkage of claim 1 wherein the elongated member is closely received in the bore for substantially precluding transverse wobble of the segment and element relative to each other.

5. The linkage of claim 1 wherein the elongated member defines a third axis at the bore, the hollow region of the segment is open to the ambient atmosphere in a direction transverse to the third axis along the second axis in at least one of two opposing directions.

6. The linkage of claim 1 wherein the segment and element are each formed as a gemstone receiving setting, the element having a hollow interior, the hollow interiors of the element and segment each for receiving at least a portion of the gemstone.

7. The linkage of claim 1 wherein the segment and element are arranged as an annular array of a plurality of abutting segments on a circular axis lying in a plane, the plurality of segments each having a hollow interior and each segment defining the second axis, the elongated member being offset from the circular axis transversely to the plane.

8. The linkage of claim 7 including a second elongated member offset from the axis on a side of the plane opposite the first elongated member.

9. The linkage of claim 8 wherein the first and second elongated members each lie in and define corresponding first and second spaced parallel planes, the first members lying in alternate first segments in a direction extending about the annular array, the second members lying in second segments which alternate with the first segments in the direction extending about the annular array.

10. The linkage of claim 1 wherein the jewelry article is a finger ring, the segment and element being arranged as a circular army of contiguous abutting segments and elements lying in a plane forming the plurality of linkage members, the plurality of segments and elements each having a hollow interior, each segment and element defining the second axis, and a faceted gemstone attached to each segment and element on a second axis and facing radially away from the central axis to form a uniform circular array of gemstones.

11. The linkage of claim 1 wherein the article is a finger ring wherein the at least one element and at least one segment comprise a plurality of contiguous abutting elements and segments of like cylindrical configuration arranged in an annular array, at least one of the segments and elements including a gemstone facing radially away from the central axis.

12. The linkage of claim 1 wherein the element and segment are identical.

13. The linkage of claim 1 including a plurality of said element and a plurality of said segment each having hollow interiors and all segments and elements being contiguous with and in abutting relationship to the next adjacent element or segment, the elements having first and second opposite faces transverse to and on the respective first and second axes, the first face facing radially outwardly away from the central axis and the second face facing radially inwardly toward the central axis, the first face being enclosed by a first wall on the elements and the first face on at least one of the segments for receiving a gemstone, the second faces of the elements and segments all being open.

14. The linkage of claim 1 including a plurality of said segment and a plurality of said first elongated member wherein the plurality of first members are aligned in a plane.

15. The linkage of claim 1 wherein the element is a segment, the segments are each generally annular with a hollow core forming said hollow region.

16. The linkage of claim 1 wherein the element is a segment and further including a plurality of identical segments.

17. The linkage of claim 1 including at least one further segment wherein the at least one further segment is elongated terminating at an end wherein the hollow region is located in a relative small portion of the further segment at at least the one further segment end.

18. The linkage of claim 1 including an arrangement to minimize transverse wobble of the element and segment relative to each other.

19. The linkage of claim 1 wherein the spring has an end portion inserted in a bore in the pin to capture the spring to the elongated element.

20. The linkage of claim 1 wherein the elongated member is a pin affixed to the element and is movable relative to the segment.

21. The flnkage of claim 1 wherein the article is any one of a finger ring, a bracelet, an anklet, a necklace and a brooch.

22. The linkage of claim 1 wherein the element is a segment, further including an annular array of said segments in said abutting relationship to each other, and a gemstone affixed to at least one of said segments and facing away from the central axis.

23. A finger ring jewelry article defining a central axis comprising:

a plurality of like generally cylindrical segments each having hollow interiors and outer generally cylindrical curved wall positioned with their outer cylindrical walls in an abutting contiguous annular array to form said finger ring, the segments each defining a radius that emanates from the central axis;

an elongated member and spring arrangement for resiliently attaching the segments to each other for resiliently urging the segments against one another in the abutting contiguous configuration in an annular direction at their curved walls so that the radii of the segments emanate from the central axis; and a gemstone attached to a gemstone setting in each segment to form an annular array of gemstones.

24. The article of claim 23 wherein the gemstones are identical and faceted.

25. The article of clam 23 wherein the gemstones are faceted like diamonds.

26. The article of claim 23 wherein the gemstones are faceted like diamonds each extending partially into the hollow interior.

27. A jewelry article comprising:

an array of jewelry segments, a plurality of said segments having a hollow core, the core being formed by an outer peripheral wall having opposing sides, said wall having a bore in the opposing sides;

a pin in the bore of each of two adjacent segments extending into the hollow core of each segment and terminating at a pin end in the core;

a coil compression spring on the pin in at least a core of a first of the two adjacent segments, the spring having an outer diameter larger than the diameter of the bore in said opposing sides; and a first arrangement at a first pin end for capturing the spring to the pin and thus to the first segment core and a second arrangement at a second pin end for securing the pin to the other of said two adjacent segments;

the segments defining a plane, the bores on said opposing sides being offset relative to each other in a direction transverse to the plane.

28. A flexible linkage for a jewelry article including a plurality of linkage members forming an annular array at least during use of the article, the annular array defining a central axis, the linkage comprising:

at least one generally cylindrical jewelry element defining a first cylinder axis and an adjacent abutting generally cylindrical jewelry segment defining a second cylinder axis, the segment and element each having an outer peripheral curved wall respectively extending generally the same extent about the corresponding first and second axes, at least the segment having a hollow internal region, said segment outer peripheral wall forming a side wall with a bore therethrough in communication with the internal region;

the element and segment forming a portion of the annular array of said linkage members, the first and second axes of the respective element and segment each comprising a radius emanating from the central axis;

a first elongated member secured to and extending outwardly from the element, the elongated member passing through the bore into the hollow internal region of the segment; and a spring secured to the elongated member in the hollow region of the segment for resiliently urging the segment toward the element in the abutting relationship with each other while permitting the segment and element to resiliently move away from each other;

the element and the segment each having a bore and hollow region, the bores of the next adjacent element and segment being aligned with and adjacent to each other, the first elongated member passing through the aligned adjacent bores into the hollow regions.

29. A jewelry article comprising:

an array of segments each having a like outer generally cylindrical peripheral wall in contiguous abutting relationship, a plurality of said segments having a hollow core, the core being formed by the outer peripheral wall having opposing sides, said wall having a bore in the opposing sides;

a pin in the bore of each of two adjacent abutting segments extending into the hollow core of each segment and terminating at a pin end in the core;

a coil compression spring on the pin in at least a core of a first of the two adjacent segments, the spring having an outer diameter larger than the diameter of the bore in said opposing sides; and a first arrangement at a first pin end for capturing the spring to the pin and thus to the first segment core and a second arrangement at a second pin end for securing the pin to the other of said two adjacent segments, the spring for urging the two abutting adjacent segments toward and against each other;

the segments defining a plane, the bores on said opposing sides being offset relative to each other in a direction transverse to the plane.

30. A jewelry article comprising:

an array of segments each having a like outer cylindrical peripheral wall in contiguous abutting relationship, a plurality of said segments having a hollow core, the core being formed by the outer peripheral wall having opposing sides, said wall having a bore in the opposing sides;

a pin in the bore of each of two adjacent abutting segments extending into the hollow core of each segment and terminating at a pin end in the core;

a coil compression spring on the pin in the core of each of the two adjacent segments, the spring having an outer diameter larger than the diameter of the bore in said opposing sides;

a first arrangement at a first pin end for capturing the spring to the pin and thus to the first segment core and a second arrangement at a second pin end for securing the pin to the other of said two adjacent segments, the spring for urging the two abutting adjacent segments toward and against each other.

* * * * *